United States Patent [19]

Denaci

[11] Patent Number: 4,530,270

[45] Date of Patent: Jul. 23, 1985

[54] METHOD OF DIRECTING A CLOSE ATTACK MISSILE TO A TARGET

[75] Inventor: Herbert G. Denaci, Massapequa Park, N.Y.

[73] Assignee: Grumman Aerospace Corporation, Bethpage, N.Y.

[21] Appl. No.: 463,776

[22] Filed: Apr. 24, 1974

[51] Int. Cl.[3] ..... F41F 5/00; F41G 7/00

[52] U.S. Cl. ..... 89/1.11; 244/3.15

[58] Field of Search ..... 89/1.5 R, 1.5 C, 1.5 S, 89/1.806, 1.807, 1.817, 1.11; 244/3.15, 3.16, 3.19

[56] References Cited

U.S. PATENT DOCUMENTS 2,932,238 4/1960 Musgrave ..... 89/1.806

3,735,944 5/1973 Bannett et al. ..... 244/3.15

*Primary Examiner*—Charles T. Jordan

*Attorney, Agent, or Firm*—Morgan, Finnegan, Pine, Foley & Lee

[57] ABSTRACT

A method of directing a close attack missile launched from a high speed aircraft flying at low altitude with precision accuracy to a target. The method includes three phases: an initial control phase after launching to stabilize and control the missile until the resultant velocity is near zero; a transition pointing phase to automatically reorient the missile after its resultant velocity approaches near zero so that its velocity vector is pointing directly at the target; and a terminal homing phase for automatically guiding the reoriented missile to the target.

10 Claims, 8 Drawing Figures

METHOD OF DIRECTING A CLOSE ATTACK MISSILE TO A TARGET

The present invention relates to a missile and more specifically to a method of directing a close attack missile which is launched from high speed aircraft flying at low altitudes to a target. The use of high speed aircraft flying at low altitudes minimizes the effectiveness of enemy surface to air missiles.

Various systems are known for guiding missiles to a radiation emitting target, see Katsanis U.S. Pat. No. 3,485,461 and Lamelot U.S. Pat. No. 3,494,576.

Various systems are also known for delivering missiles from an aircraft, see Walker U.S. Pat. No. 2,470,120; Gehrkens et al. U.S. Pat. No. 1,977,853; and Von Maydell U.S. Pat. No. 3,538,809. Walker discloses a method of bombing in which the horizontal velocity of the bomb is reduced to substantially zero by a jet reaction upon release, so that the bomb drops substantially vertically. Gehrkens et al. discloses a method of bombing in which the bomb is released when the aircraft is in a vertical position over the target. Von Maydell discloses a close attack missile system for high speed aircraft in which the missiles are released from the aircraft after it has passed over the target and undergo a looping path to the target. Control surfaces on the missiles determine the path of the looping movement.

It is an object of the present invention to provide a method of automatically directing a close attack missile from low flying, high speed aircraft which close attack missile is capable of precision accuracy over a wide range of launch velocities, altitudes, and lateral distance and range displacements from the target.

It is a further object of the present invention to provide a method of directing a close attack missile against targets which are at close range and/or affording only a minimum detection time where conventional weapons cannot be used.

It is a further object of the present invention to provide a method of directing a close attack missile to a target which does not require that the target be detected until the aircraft is in the immediate vicinity of the target, and which enables the target to be "hit" when the aircraft is on its initial pass.

It is a further object of the present invention to provide a method of directing a close attack missile to a target by initially controlling the missile after launching to maintain its azimuth attitude and minimize its vertical and horizontal velocity.

Other objects, aspects, and advantages of the present invention will be apparent from the detailed description considered with the accompanying drawings.

Briefly, the method of delivering a close attack missile of the present invention includes three steps or phases, an initial control phase to control the launched missile to provide near zero resultant velocity while maintaining its launched azimuth attitude, a transition pointing phase to automatically reorient the missile after its resultant velocity approaches near zero so that its velocity vector points directly at the target, and a terminal homing phase for automatically guiding the reoriented missile to the target.

The present invention is illustrated in the drawings, in which.

Figure 1:
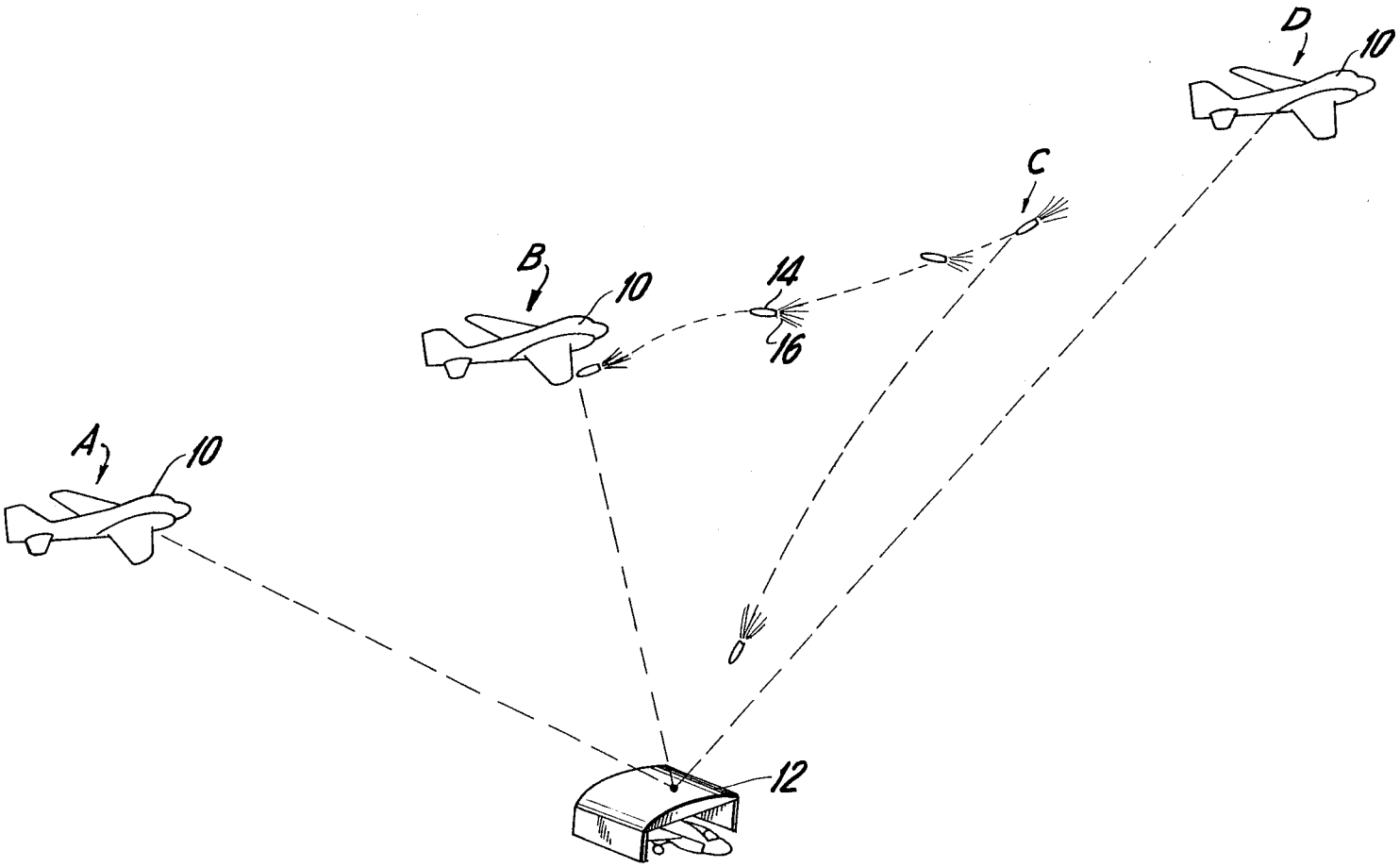
FIG. 1 is a perspective view of an aircraft approaching a target and launching a missile.

Referring to FIG. 1, an aircraft 10 is shown approaching and passing a target 12, after launching a missile 14. The missile 14 is launched while the aircraft is flying at high speed, i.e., between about 400 and about 700 mph, and low altitude, i.e., between about 100 and about 3,000 feet. The missile 14 may be launched before, at, or after the point of closest approach, or at a significant lateral displacement from the target 12. At point A, shortly before the aircraft 10 reaches the vicinity of the target 12, a target tracking sequence is usually initiated in the aircraft 10. At point B, the rearward flying missile 14 is launched from the aircraft 10 and its rocket 16 is ignited so that the thrust is directed in a direction substantially opposite to the flight path of the aircraft 10 and the missile 14.

After launching, the missile 14 maintains its azimuth attitude and the direction of the thrust from rocket 16 is controlled to minimize the vertical and horizontal velocity of the missile 14. When the condition of near minimum resultant velocity is attained at point C, the missile pitch and azimuth attitudes are reoriented so that the resultant force vector (combination of thrust and gravity) points directly at the target 12. After reorientation at point C, the missile 14 is automatically guided to the target 12. Advantageously, where the target tracker system of the missile 14 cannot distinguish between the target 12 and the background, a laser illuminator system in the aircraft 10 can be utilized to designate the target 12, see point D.

Figure 2:
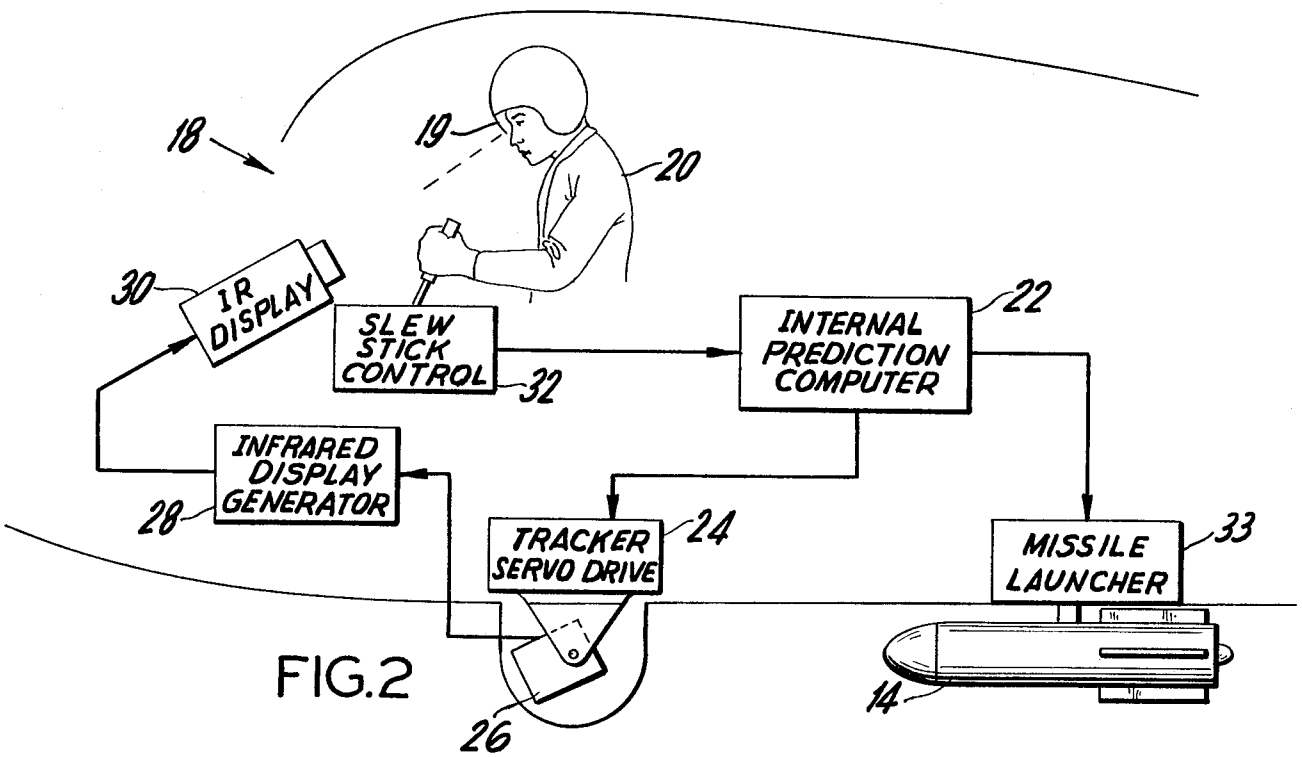
FIG. 2 is an aircraft system diagram of a suggested missile launching and tracking system for the launch aircraft.

Referring also to FIG. 2, one embodiment of a missile launching, target tracking and designating system is illustrated at 18. The operator 20 visually determines the target 12, as follows. With the aid of a conventional helmet sight system 19, he designates the target 12 by transmitting a signal to an internal prediction computer 22 which controls a tracker servo drive 24. The tracker servo drive 24 controls the angular position of an infrared scanner and laser designator 26. The output signals from the infrared scanner and laser designator 26 are transmitted to an infrared display generator 28 and an infrared display 30. The operator 20 checks the infrared display 30 and utilizes a slew stick control 32 to provide correction signals to the internal prediction computer 22 to keep the infrared scanner and laser designator 26 precisely on target 12. The signal to the missile launcher 33 to launch the missile 12 is provided by the internal prediction computer 22, or by the operator 20, as desired.

Figure 3:
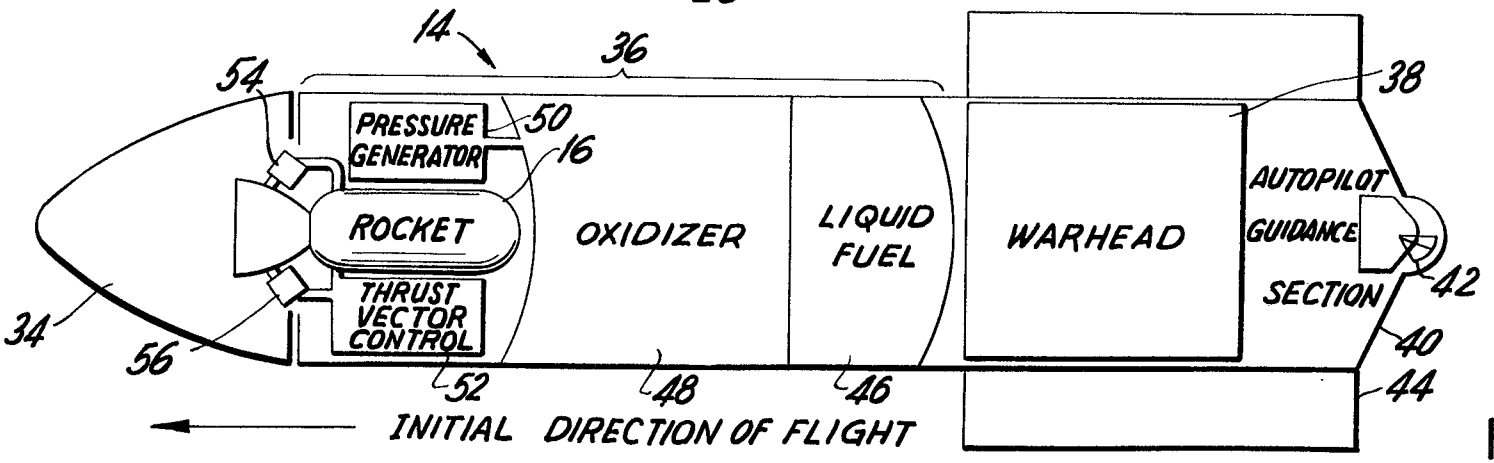
FIG. 3 is a sectional view of one suggested missile configuration and component arrangement.

Referring to FIG. 3, one general configuration for the missile 14 is shown. Advantageously, the missile 14 may include a jettisonable end fairing 34 adjacent the rocket 16. However, if the missile 14 is carried in an internal bay or other aerodynamically sheltered location, the fairing 34 may be eliminated. The missile 14 includes a propulsion system 36, a warhead 38, an autopilot-guidance section 40, and a target detector and tracker 42. Advantageously, jettisonable fins 44 may be included for stability during the short time interval between launching from the aircraft and activation of the propulsion system 36.

The rocket propulsion system 36 is activated either by separation of an umbilical cord or by a timer generally within one second after launching of the missile 14, and remains activated until impact with the target 12. The rocket propulsion system 36 includes a liquid fuel tank 46, an oxidizer tank 48, and a pressure generator 50. The liquid fuel tank 46 and oxidizer tank 48 are pressurized by the pressure generator 50; the pressurized fuel and oxidizer within the tanks 46 and 48, respectively, is then supplied to the rocket 16. It should be understood that solid fuel as well as liquid fuel rocket propulsion systems may be employed in the missile 14.

A thrust vector control 52 is activated either at the time of or prior to activation of the rocket propulsion system 36 to control the attitude of the missile 14. Nozzle injectors 54 and 56 are shown as one possible means for deflecting the rocket thrust to control the attitude of the missile 14. Jet vanes or spoilers and the use of rocket nozzle gimballing are other possibilities which may be used to deflect the rocket thrust and control the missile attitude. Further, a separate hot gas mass expulsion system may be used in place of the thrust vector control 52 to control the attitude of the missile 14.

The autopilot-guidance section 40 includes conventional sensors (gyroscopes and accelerometers), amplifiers, and computers to stabilize and control the missile 14. The gyroscopes are conventionally arranged to measure angular velocities about the axes of the missile 14. A pair of accelerometers are used to measure accelerations along the longitudinal and normal axes of the missile 14, respectively.

The target detector and tracker 42 may include a conventional laser detector, an infrared detector, or a dual mode detector unit. The target detector and tracker 42 provides input signals to the autopilot-guidance section 40 for activating the thrust vector control 52 to control the attitude of the missile 14 and therefore its flight path.

Figure 4:
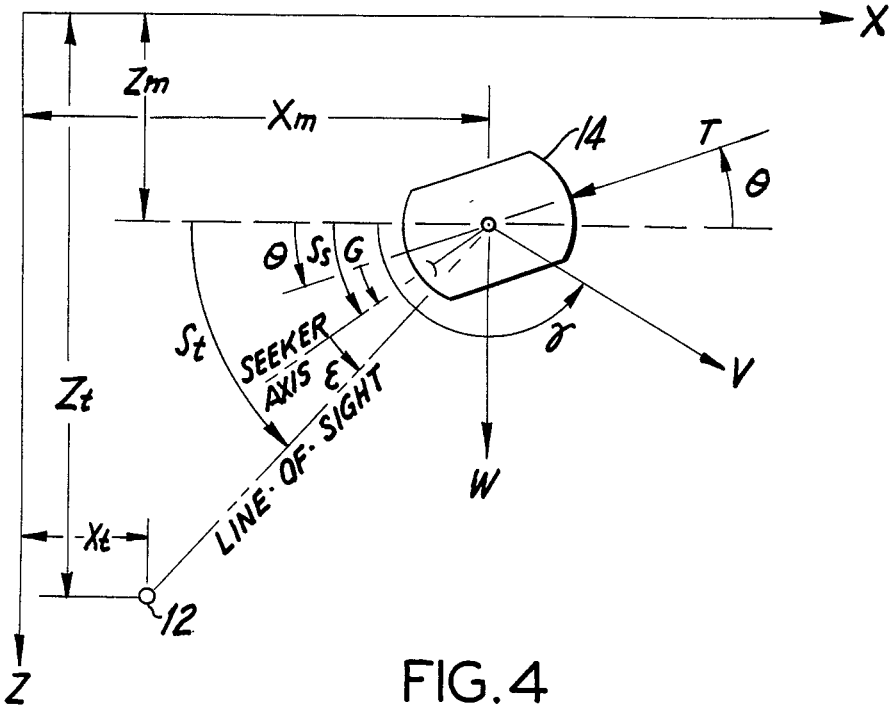
FIG. 4 is a side view of a launched missile showing various parameters useful in describing the movement of the missile.

A launched missile 14 is illustrated in FIG. 4 including various parameters which are believed helpful in understanding the method of the present invention. The parameters given are for the vertical plane of operation only. It should be understood that there is also a horizontal plane of operation similar to, but simpler than, the vertical plane of operation. The description of the horizontal plane of operation has been omitted to facilitate description.

The parameters shown in FIG. 4 are as follows:

X = the fixed horizontal axis

Figures 5, 6:
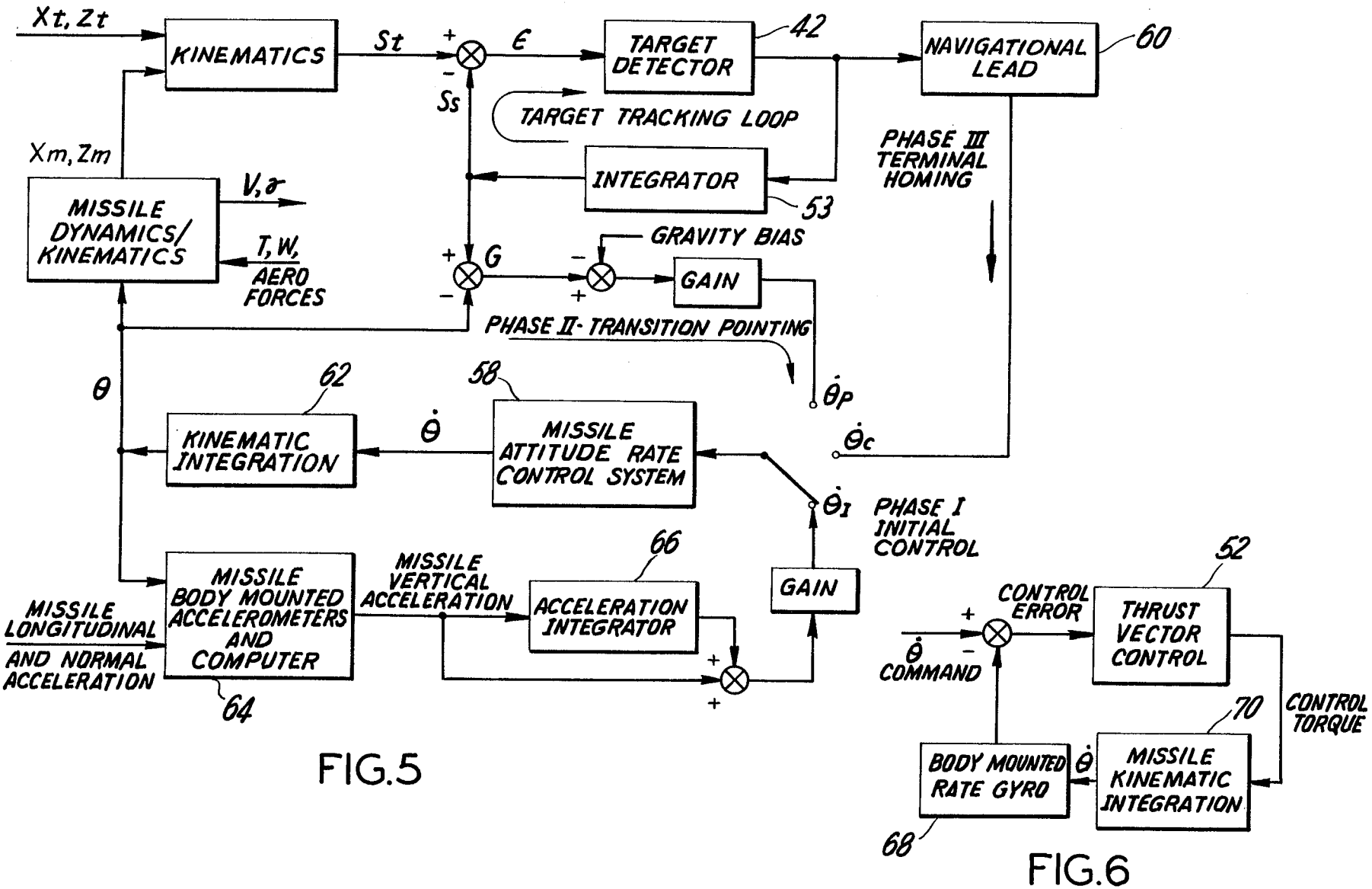
FIG. 5 is a functional block diagram of the missile guidance and control system.
FIG. 6 is a functional block diagram of the missile attitude rate control system.

Z = the fixed vertical axis $X_m$ = the horizontal coordinate of missile $Z_m$ = the vertical coordinate of missile $X_t$ = the horizontal coordinate of target $Z_t$ = the vertical coordinate of target $S_t$ = the angle between the horizontal axis and the line-of-sight from the center of the missile to the target $S_s$ = the angle between the horizontal axis and the target-seeker axis $\epsilon$ = the angle between the line-of-sight to the target and the target-seeker axis $S_t$-$S_s$ $\theta$ = the missile attitude angle between the fixed horizontal axis and the longitudinal axis of the missile G = the gimbal angle between the longitudinal axis of the missile and the target seeker axis V = the missile velocity vector $\gamma$ = the angle of the missile flight path between the horizontal axis and the missile velocity vector T = the rocket thrust vector W = the missile weight FIG. 5 illustrates the functional relationship and interaction between the various missile parameters set forth in FIG. 4. The method of directing a close attack missile 14 to the target 12 includes three steps or phases:

I. Initial Control After Launching

II. Transition Pointing

III. Terminal Homing

During phase I the missile 14 is stabilized and controlled from the time of launching at its initial velocity until its resultant velocity is reduced to near zero. The rocket thrust vector T causes deceleration of the missile 14 and the missile attitude angle, $\theta$, is controlled by the thrust vector control 52 so that ultimately the vertical component of the thrust vector T will balance out the gravity vector W. An automatic control loop in the autopilot-guidance section 40 provides a pitch rate command signal $\theta_I$ which reorients the attitude of the missile 14 so that its vertical velocity approaches near zero, i.e., a resultant velocity V near zero. By a resultant velocity of near zero is meant a velocity within about fifty feet/-second. A velocity of near zero at the end of phase I is essential in order to achieve a high terminal homing accuracy in phase III. When the horizontal velocity of the missile 14 approaches near zero, control and guidance of the missile 14 is automatically switched from phase I to phase II transition pointing.

It should be noted that during phase I, no information on target location is required. However, it is necessary that the missile target detector and tracker 42 locate and track the target 12 prior to switchover to phase II.

Phase II provides the transition between the initial control of phase I and the terminal homing of phase III. The essential requirement of phase II is that the resultant velocity vector V of the missile 14 is changed or reoriented from a near horizontal position to point almost directly at the target 12. This requirement is accomplished as follows. The spatial positions of the target 12 and missile 14, $X_t$, $Z_t$, and $X_m$, $Z_m$, respectively, establish the line-of-sight angle $S_t$. The target detector and tracker 42 provides an output signal which drives a tracking loop integrator 53, see FIG. 5, which causes the angle $S_s$ of the tracker seeker axis to closely follow $S_t$. For the range of input frequencies of interest in the tracking, the tracking error angle $\epsilon$ is a measure of the rate of change of $S_t$. The gimbal angle G ($G = S_s - \theta$) is monitored to provide the pitch rate command signal $\theta$ p which rotates the missile 14 until the thrust vector T points almost directly at the target 12.

It is necessary, however, in the vertical plane of control that the thrust vector T be displaced slightly from the line-of-sight to the target 12, generally on the order of 10 degrees, so that the resultant force of the thrust vector T and the weight vector W will point directly at the target 12. To accomplish this, a gravity bias is introduced into the automatic control loop during phase II. The gravity bias is a function of the missile thrust vector T, missile weight W, and attitude angle $\theta$. (For control in the horizontal plane, a gravity bias is not required.) Only a short time interval, e.g., about 1.5 to 2.0 seconds, is required to achieve the desired transition pointing in phase II and the switchover to phase III terminal homing.

During phase III, the seeker or tracking loop error angle $\epsilon$, which is a measure of the rate of change of $S_t$, is multiplied by the navigational lead 60 to provide a missile pitch rate signal $\theta_c$. The technique employed to control the missile 14 during phase III is known as "proportional navigation". This technique is well known in the art and provides excellent terminal accuracy even when used against moving targets. When employing proportional navigation, the rate of change of attitude of the missile 14 is proportional to a navigational lead ratio (a finite number greater than unity) times the rate of change of the line-of-sight between the missile 14 and target 12.

It is necessary for precision accuracy that the flight path of the missile 14 be oriented nearly directly at target 12 at the end of phase II. This is important for missile accuracy because of the short time available for corrections in phase III as compared to the slow flight path response of the missile 14 after it has accelerated to a significant velocity. Limited bias signals may be applied phase III to improve terminal accuracy for specific missile configurations, as desired.

As indicated in FIG. 5, the pitch rate command signals $\theta_I$, $\theta_P$ and $\theta_C$, for each of the phases, are converted by the missile attitude rate control system 58 to become the missile pitch attitude rate $\theta$. The missile pitch attitude rate $\theta$, is kinematically integrated at 62 to become the actual missile attitude $\theta$.

During phase I the missile is stabilized and controlled from the time of launching at its initial velocity until its velocity is reduced to near zero. The thrust vector T causes deceleration of the missile 14 and controls the missile attitude angle, $\theta$, so that the vertical component of the thrust vector T will balance out the gravity vector W. The missile's longitudinal and normal accelerations are measured and resolved by body mounted accelerometers and computer 64 into the vertical acceleration of the missile in space. The vertical acceleration is combined with the output of the integrator 66 to provide the initial pitch rate command signal $\theta_I$. The pitch rate command signal $\theta_I$ is applied to the missile attitude rate control system 58 and integrated, as previously described, to reorient the attitude of the missile 14 so that its vertical velocity approaches near zero as its horizontal velocity approaches near zero. When the horizontal velocity of the missile 14 approaches near zero, control and guidance of the missile 14 is automatically switched from Phase I to Phase II—transition pointing.

During phase II the missile 14 is reoriented to an angle $\theta_P$ by monitoring the gimbal angle $G(S_s-\theta)$ to provide a pitch rate command signal $\theta_P$. A gravity bias signal is subtracted from G in arriving at the pitch rate command signal to account for the error introduced on account of the weight of the missile 14. The pitch signal $\theta_P$ is applied to the missile attitude rate control system 58 and integrator 62, as previously discussed, to reorient the missile until the thrust vector T points almost directly at the target.

During phase III, the missile 14 is automatically guided along the line-of-sight from the center of the missile 14 to the target 12 through a target tracking loop which includes the target detector and tracker 42 and integrator 53. A signal proportional to the error angle $\epsilon$ is applied to the navigational lead 60 to provide a pitch rate command signal $\theta_C$. The pitch rate command signal $\theta_C$ is applied to the missile attitude rate control system 58 and integrator 62, as previously discussed, to direct the missile 14 to the target 12.

The combination of missile attitude $\theta$, thrust T, weight W, and aerodynamic forces result in variations in the missile velocity V, flight path $\gamma$, and displacements $X_m$ and $Z_m$. These parameters, as well as the target positions, $X_t$ and $Z_t$, provide the feedback to close the pointing and guidance loops of phases II and III, respectively.

Referring to FIG. 6, a functional block diagram of the missile attitude rate control system 58 is shown. The missile rate command signal ($\theta_I$, $\theta_P$, or $\theta_C$) is compared with the output of a body mounted rate gyro 68 to produce the control error signal. The thrust vector control 52 is driven by the control error signal to produce a control torque on the airframe of the missile 14. The control torque is kinematically integrated at 70 to form the missile pitch rate $\theta$.

Figure 7:
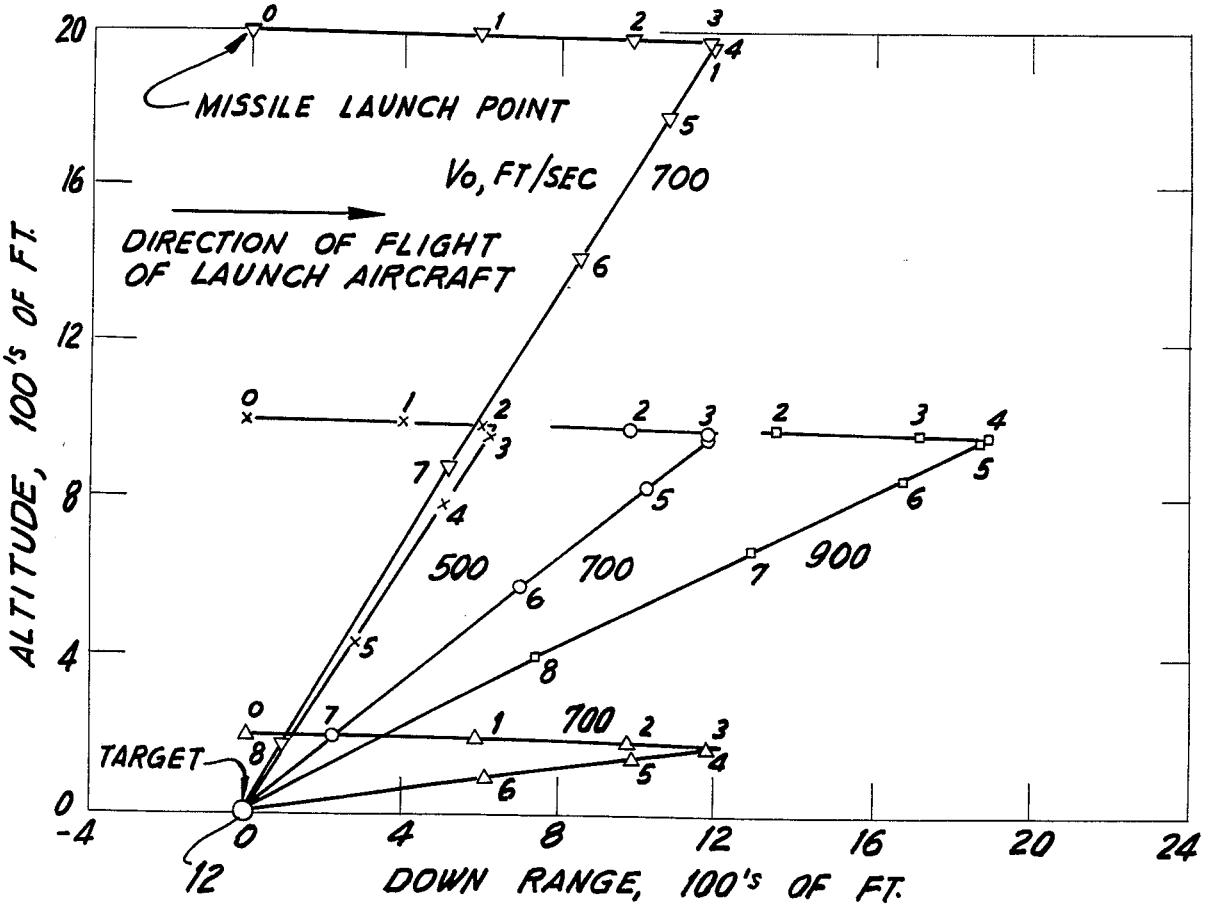
FIG. 7 is a graphic representation of computer simulations for the block diagram of FIG. 5.

Dynamic computer simulations were made of a launched missile 14 controlled by the present invention and the results are shown graphically in FIG. 7. The missile trajectories are plotted for a series of simulated releases directly over the target 12. The simulated launch altitudes were 200, 1000, and 2000 feet with release or initial missile velocities of 700 feet per second. Also, two additional simulated launchings were made at an altitude of 1000 feet with launch velocities of 500 and 900 feet/sec. For a release velocity of 700 feet per second, initial control (phase I) lasted for $3.\overline{3}$ seconds and transition pointing (phase II) terminated at 4.8 seconds. Considering the trajectories for the 700 feet per second releases, the missile 14 abruptly changes its trajectory between 3 and 4 seconds after launching and is flying almost exactly on target slightly less than 5 seconds after launching. Simulations for stationary targets provided miss distances of generally less than 10 feet.

Figure 8:
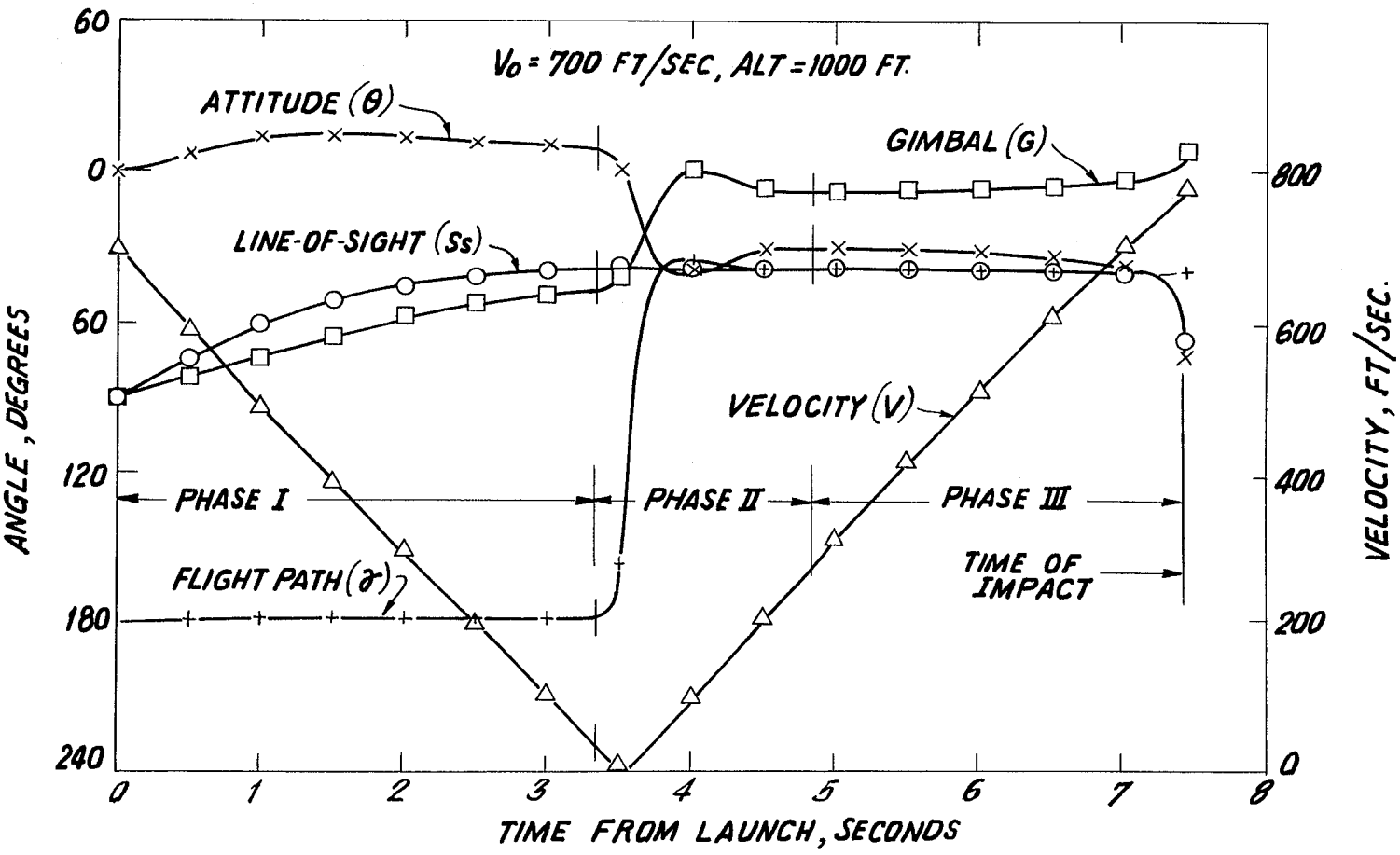
FIG. 8 is a graphic representation of a computer simulation showing the changes in the various parameters of FIG. 4 during the three phases.

Referring to FIG. 8, time changes in the parameters of one of the dynamic computer simulation of FIG. 4 are illustrated. The missile 14 was launched at an altitude of 1000 feet and with a velocity of 700 feet per second. The switchover from phase I occurs when the missile velocity is within about fifty per second of zero. The missile flight path, $\gamma$, is approximately 180 degrees until the end of phase I, and then is rapidly changed to be coincident with the line-of-sight to the target, $S_s$. During phase I, the missile attitude angle, $\theta$, is controlled by the accelerometer feedback loop, see FIG. 5, so that the vertical velocity of the missile 14 is reduced to near zero.

A comprehensive three-dimensional representation of the missile kinematic and guidance relations including pitch, yaw, and roll control and a two gimbal seeker are provided in Appendices A, B, C, and D. Appendix A provides a tabulation in conventional and Fortran notation. Appendix B is a flow chart for the program. Appendix C shows the detailed line program for use in the computer. Appendix D shows the computer print out for two sample cases. The first sample case included an initial velocity of 800 feet per second, an altitude of 1000 feet, a cross-range displacement of 1000 feet, along-range displacement of zero and an attitude angle of zero. The second case included identical initial conditions, except that the cross-range displacement was zero. The Fortran program can be run on a CALL-DATA Time Shaving terminal of the IBM 360-67, or in batch processing on the IBM 370/165 or on other units.

The altitude at release, for the same release velocity, has substantially no effect on time required for phase I. However, it does affect the turn angle required in phase II and the length of time in phase III, and therefore the total length of time that the missile 14 is in flight. The initial velocity of the missile 14 directly affects the time required for phase I, see FIG. 7 for the launchings at 500 feet per second and 900 feet per second, and therefore the total length of time that the missile 14 is in flight. Most importantly, the terminal accuracy of the missile 14 is not significantly affected by variations in altitude and velocity at release.

In deploying the method of the present invention, the target 12 is located with the aid of the missile launching and tracking system 18, as illustrated in FIG. 2. The missile 14 is launched manually or by computer 22. The point at which the missile 14 is launched may be prior to, above, or after passing over the target 12, and may be at a significant lateral displacement from the target 12.

Within about 1 second after launching of the missile 14, its rocket 16 is ignited. The autopilot and guidance section 40 operate to control the azimuth attitude and direction of the thrust vector T for an initial period of time (phase I) until the resultant velocity of the missile 14 is near zero. Phase I control is accomplished entirely by the autopilot and guidance section 40 of the missile 14 and does not require external signals from the target 12. The missile body mounted accelerometers and computer 64 and integrator 66 in the autopilot-guidance section 40 provide a pitch rate command signal to reorient the missile 14 so that the vertical component of the thrust vector T balances out the weight vector W and the vertical velocity approaches zero as the horizontal velocity approaches near zero. As the horizontal velocity approaches near zero, phase I operation is terminated and phase II begins.

However, the target detector and tracker 42 must acquire the position of the target 12 prior to entering phase II. This may be achieved by illuminating the target 12 with light emitted from the laser designator portion of scanner and laser designator 26. The target detector and tracker 42 senses this reflected light and transmits signals indicative of target location to the autopilot guidance section 40.

During phase II the missile 14 is reoriented so that resultant velocity vector is changed from near horizontal to pointing almost directly at the target 12. This is accomplished by providing pitch rate command signals $\theta_P$ which reorient the missile 14 until the thrust vector T points almost directly at the target 12. A gravity bias signal is introduced to correct for error caused by the weight W of the missile 14.

After the missile 14 is pointing almost directly at the target 12, phase II is terminated and phase III begins. In phase III, the target tracking loop error $\epsilon$ is multiplied by the navigational lead to provide a missile pitch rate command signal $\theta_C$. The missile pitch rate command signal $\theta_C$ maintains the missile 14 precisely on target until impact.

It should be understood that the preceding description was presented as illustrative of the present invention and should not be construed in a limiting sense. It should further be understood by those skilled in the art that various modifications may be made in the present invention without departing from the spirit and scope thereof as described in the specification and defined in the appended claims.

APPENDIX I - NOTATION (All notation is given first in conventional and second in Fortran usage)

A. Coordinate Systems

Two sets of orthoginal axes plus the missile seeker gimbal axes are used to define the three-dimensional motions and kinematics of this overall missile - guidance simulation. These axis systems are defined by the following:

$X_I$, $Y_I$, $Z_I$ (XI, YI, ZI): Fixed inertial axes used to define the relative positions of missile and target $X_M$, $Y_M$, $Z_M$ (XM, YM, ZM): Missile longitudinal, lateral, and normal body axes with origin at the missile center of mass, and angularly displaced from the $X_I$, $Y_I$, $Z_I$ axes by the Euler angles, $\psi$, $\theta$, and $\phi$ (PS, TH, PH)

$X_S$, $Y_S$, $Z_S$ (XS, YS, ZS): Seeker axis system with $X_S$ in the direction of the seeker boresight, and angular displacements from the missile $X_M$, $Y_M$, $Z_M$ axes by the gimbal angles $G_Z$ and $G_Y$ (GZ, GY) respectively B. Definition of Symbols $V_A$ (VA), Launch aircraft velocity, ft/sec $X_{IM}$ (XIM), $Y_{IM}$ (YIM), $Z_{IM}$ (ZIM), Missile coordinates in inertial axes, ft $X_{IT}$ (XIT), $Y_{IT}$ (YIT), $Z_{IT}$ (ZIT), Target coordinates in inertial axes, ft $\psi$ (PS), $\theta$ (TH), $\phi$ (PH), Missile Euler angular displacements from the inertial axis, rad ___ (DT), Time increment between iterative calculations, sec g (GC), Gravitational constant, ft/sec$^2$ T/W (TTW), Thrust-to-weight ratio, nondim $C_N$ (CN), Navigation load, nondim $C_{C1}$ (CC1), $C_{N1}$ (CN1), Chord force and normal force basic coefficient, nondim S/W (STW), Ratio of missile cross-sectional reference area to weight, ft$^2$/lb t (T), Time from initiation of problem, sec ___ (T2), Time increment between printouts, sec ___ (T3), Time of switchover from Phase 1 to Phase 2, sec ___ (T4), Time of switchover from Phase 2 to Phase 3, sec ___ (T5), Time increment used in calculation of T3, sec ___ (T6), Time increment in calculation of terminal errors, sec $V_{EJ}$ (VEJ), Normal velocity of missile at end of ejection, ft/sec $V_{MX}$ (VMX), $V_{MY}$ (VMY), $V_{MZ}$ (VMZ), Components of missile velocity along missile $X_M$, $Y_M$, $Z_M$ axes, respectively, ft/sec $V_M$ (VM), Resultant missile velocity, ft/sec $G_Y$ (GY), $G_Z$ (GZ), Seeker pitch and yaw gimbal angles, respectively, rad $C_S$ (CS), Pitch and yaw tracking loop gains, 1/sec $C_P$ (CP), Phase 2 pitch and yaw pointing loop gains, 1/sec $C_\phi$ (CPH), Roll control loop gain, 1/sec $C_T$ (CT), Pitch and yaw control loop gains, 1/sec $C_I$ (CI), Vertical acceleration integrator gain, 1/sec $C_V$ (CV), Vertical velocity - attitude rate gain, rad/ft $V_{TX}$ (VTX), $V_{TY}$ (VTY), Components of target velocity along the inertial $X_I$ and $Y_I$ axes respectively, ft/sec $V_T$ (VT), Target velocity, ft/sec M (AM), Missile Mach number, nondim $M_F$ (AMF), Mach number factor, nondim $C_{CM}$ (CCM), $C_{NM}$ (CNM), Chord force and normal force coefficients at given Mach number, nondim $C_{C2}$ (CC2), $C_{N2}$ (CN2), Chord force and normal force coefficients at given angle of attack, nondim $\alpha$ (AL), angle of attack, rad $\phi_\alpha$ (PHAL), Roll angle of relative wind to missile body axis, rad q (QA), Dynamic pressure, lbs/sq ft Fc/W (FCW), Ratio of chord force to weight, nondim $F_N/W$ (FNW), Ratio of normal force to weight, nondim $A_{MX}$ (AMX), $A_{MY}$ (AMY), $A_{MZ}$ (AMZ), Acceleration along the missile X, Y, and Z axes, respectively, ft/sec $A_{MZI}$ (AMZI), Portion of acceleration along missile Z axis, ft/sec$^2$ $V_{MX}$ (VMX), $V_{MY}$ (VMY), $V_{MZ}$ (VMZ), Components of velocity along the missile X, Y, and Z axes, respectively, ft/sec $V_M$ (VM), Missile velocity, ft/sec $V_{IX}$ (VIX), $V_{IY}$ (VIY), $V_{IZ}$ (VIZ), Components of missile velocity along the inertial X, Y, and Z axes respectively, ft/sec $Z_{DIF}$ (ZDIF), Difference in altitude between missile and target, ft $R_{MT}$ (RMT), Range between missile and target, ft $D_{IX}$ (DIX), $D_{IY}$ (DIY), $D_{IZ}$ (DIZ), Directional cosines between the line-of-sight from missile to target and the inertial space axes, nondim $D_{MX}$ (DMX), $D_{MY}$ (DMY), $D_{MZ}$ (DMZ), Directional cosines of the target in missile axes, nondim $D_{SX}$ (DSX), $D_{SY}$ (DSY), $D_{SZ}$ (DSZ), Directional cosines of the target in seeker axes, nondim $\epsilon_Y$ (EY), $\epsilon_Z$ (EZ), Seeker Tracking error angles about the Y and Z axes, respectively, rad $\omega_{MXC}$ (WMXC), $\omega_{MYC}$ (WMYC), $\omega_{MZC}$ (WMZC), Command for angular velocity about the missile X, Y, and Z axes respectively (Subscripts 1, 2 and 3 refer to the guidance mode of operation), rad/sec $\epsilon_{AZ}$ (EAZ), Vertical ~~Vertical~~ acceleration ~~acceleration~~ error, ft/sec$^2$ $\epsilon_{AZI}$ (EAZI), Integral of acceleration error, ft/sec $\omega_{MX}$ (WMX), $\omega_{MY}$ (WMY), $\omega_{MZ}$ (WMZ), Angular velocity about the missile X, Y, and Z axes, respectively, rad/sec $\dot{\phi}$ (PHD), $\dot{\theta}$ (THD), $\dot{\psi}$ (PSD), Rate of change of the missile Euler angles, rad/sec $\dot{G}_Y$ (GYD), $\dot{G}_Z$ (GZD), Rate of change of the pitch and yaw gimbal angles, rad/sec $X_{ERR}$ (XERR), $Y_{ERR}$ (YERR), Terminal error or miss distances in the horizontal plane of the target, ft $R_{ERR}$ (RERR), Range error or miss distance at point of closest approach to the target, ft

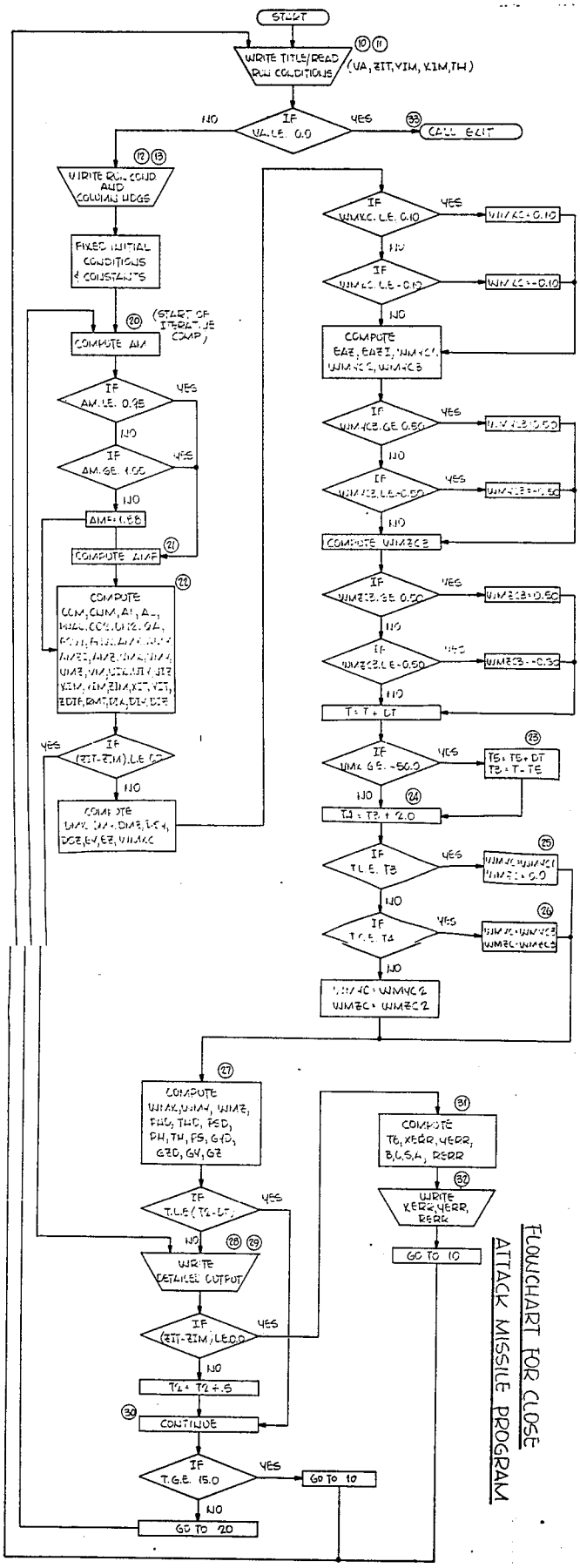
FLOWCHART FOR CLOSE ATTACK MISSILE PROGRAM
APPENDIX B

```
C       3-D CLOSE ATTACK MISSILE PROGRAM                                HGD00010
  10    WRITE(6,11)                                                     HGD00020
  11    FORMAT(' ',//11X,'CLOSE ATTACK MISSILE SOLUTION'//              HGD00030
       Q' VA,ZIT,YIM,XIM,TH=')                                          HGD00040
        READ(5,12)VA,ZIT,YIM,XIM,TH                                     HGD00050
        IF(VA.LE.0.0) GO TO 33                                          HGD00060
  12    FORMAT(5F7.1)                                                   HGD00070
        WRITE(6,13)VA,ZIT,YIM,XIM,TH                                    HGD00080
  13    FORMAT('0',5F7.1,//T4,'T',T10,'XIM',T16,'YIM',T21,'ZDIF',T29,   HGD00090
       Q'VM',T34,'WMX',T41,'WMY',T48,'WMZ',T55,'PH',T62,'TH',T69,'PS',  HGD00100
       QT76,'EY',T83,'EZ',T90,'GY',T97,'GZ',T104,'AL',T110,'PHAL',      HGD00110
       QT117,'T3'/)                                                     HGD00120
        DT=0.01                                                         HGD00130
        GC=32.1739                                                      HGD00140
        TTW=6.0                                                         HGD00150
        CN=6.0                                                          HGD00160
        CC1=0.5                                                         HGD00170
        CN1=2.0                                                         HGD00180
        STW=0.0025                                                      HGD00190
        T=0.0                                                           HGD00200
        T2=0.5                                                          HGD00210
        T3=6.0                                                          HGD00220
        T5=-DT                                                          HGD00230
        XIT=0.0                                                         HGD00240
        YIT=0.0                                                         HGD00250
        ZIM=0.0                                                         HGD00260
        VEJ=20.0                                                        HGD00270
        VMX=-VA                                                         HGD00280
        VMY=0.0                                                         HGD00290
        VMZ=-VEJ                                                        HGD00300
        VTX=00.0                                                        HGD00310
        VTY=00.0                                                        HGD00320
        VIZ=VMX*SIN(TH)-VMZ*COS(TH)                                     HGD00330
        VM=SQRT(VMX**2+VMZ**2)                                          HGD00340
        WMX=0.0                                                         HGD00350
        WMY=0.0                                                         HGD00360
        WMZ=0.0                                                         HGD00370
        PH=0.0                                                          HGD00380
        PS=0.0                                                          HGD00390
        GY=0.0                                                          HGD00400
        GZ=0.0                                                          HGD00410
        CS=10.0                                                         HGD00420
        CP=4.0                                                          HGD00430
        CPH=5.0                                                         HGD00440
        CTX=10.0                                                        HGD00450
        CT=5.0                                                          HGD00460
        CI=0.5                                                          HGD00470
        CV=0.013                                                        HGD00480
        EAZI=-VIZ*CI*1.5                                                HGD00490
C       COMPUTE                                                         HGD00500
  20    AM=VM/1116.89                                                   HGD00510
        IF(AM.LE.0.95)GO TO 21                                          HGD00520
        IF(AM.GE.1.05)GO TO 21                                          HGD00530
        AMF=1.88                                                        HGD00540
        GO TO 22                                                        HGD00550
```

```
  21    AMF=0.6+0.4/SQRT(A S(1.0-AM**2))                                HGD00560
  22    CCM=CC1*AMF                                                     HGD00570
        CNM=CN1*AMF                                                     HGD00580
        A1=SQRT(VMY**2+VMZ**2)                                          HGD00590
        AL=ATAN2((A1),(VMX))                                            HGD00600
        PHAL=ATAN2((-VMY),(VMZ))                                        HGD00610
        CC2=CCM*COS(AL)                                                 HGD00620
        CN2=CNM*SIN(AL)                                                 HGD00630
        QA=1481.35*AM**2                                                HGD00640
        FCW=QA*STW*CC2                                                  HGD00650
        FNW=QA*STW*CN2                                                  HGD00660
        AMX=GC*(TTW-FCW+SIN(TH))                                        HGD00670
        AMY=GC*(FNW*SIN(PHAL)-COS(TH)*PH)-VMX*WMZ                       HGD00680
        AMZI=GC*(-FNW*COS(PHAL)-COS(TH))                                HGD00690
        AMZ=AMZI+VMX*WMY                                                HGD00700
        VMX=VMX+AMX*DT                                                  HGD00710
        VMY=VMY+AMY*DT                                                  HGD00720
        VMZ=VMZ+AMZ*DT                                                  HGD00730
```

```
      VM=SQRT(VMX**2+VMY**2+VMZ**2)                                     HGD00740
      VIX=-VMX*(COS(TH)*COS(PS))+VMY*(SIN(PS)-PH*SIN(TH)*COS(PS))       HGD00750
     Q-VMZ*(SIN(TH)*COS(PS)+PH*SIN(PS))                                 HGD00760
      VIY=-VMX*(COS(TH)*SIN(PS))-VMY*(COS(PS)+PH*SIN(TH)*SIN(PS))       HGD00770
     Q+VMZ*(PH*COS(PS)-SIN(TH)*SIN(PS))                                 HGD00780
      VIZ=VMX*SIN(TH)-VMY*(PH*COS(PS))-VMZ*COS(TH)                      HGD00790
      XIM=XIM+VIX*DT                                                    HGD00800
      YIM=YIM+VIY*DT                                                    HGD00810
      ZIM=ZIM+VIZ*DT                                                    HGD00820
      XIT=XIT+VTX*DT                                                    HGD00830
      YIT=YIT+VTY*DT                                                    HGD00840
      ZDIF=ZIT-ZIM                                                      HGD00850
      RMT=SQRT((XIM-XIT)**2+(YIM-YIT)**2+(ZIT-ZIM)**2)                  HGD00860
      DIX=(XIM-XIT)/RMT                                                 HGD00870
      DIY=(YIM-YIT)/RMT                                                 HGD00880
      DIZ=(ZIM-ZIT)/RMT                                                 HGD00890
      IF((ZIT-ZIM).LE.0.0)GO TO 28                                      HGD00900
      DMX=DIX*(COS(PS)*COS(TH))+DIY*(SIN(PS)*COS(TH))-DIZ*SIN(TH)       HGD00910
      DMY=DIX*(COS(PS)*SIN(TH)*PH-SIN(PS))+DIY*(SIN(PS)*SIN(TH)*PH      HGD00920
     Q+COS(PS))+DIZ*(COS(TH)*PH)                                        HGD00930
      DMZ=DIX*(COS(PS)*SIN(TH)+SIN(PS)*PH)+DIY*(SIN(PS)*SIN(TH)-        HGD00940
     QCOS(PS)*PH)+DIZ*COS(TH)                                           HGD00950
      DSY=-DMX*SIN(GZ)+DMY*COS(GZ)                                      HGD00960
      DSZ=DMX*(COS(GZ)*SIN(GY))+DMY*(SIN(GZ)*SIN(GY))+DMZ*COS(GY)       HGD00970
      EY=-DSZ                                                           HGD00980
      EZ=DSY                                                            HGD00990
      WMXC=-CPH*PH                                                      HGD01000
      IF(WMXC.GE.0.10)WMXC=0.10                                         HGD01010
      IF(WMXC.LE.-0.10)WMXC=-0.10                                       HGD01020
      EAZ=AMZI*COS(TH)-AMX*SIN(TH)                                      HGD01030
      EAZI=EAZI+EAZ*CI*DT                                               HGD01040
      WMYC1=CV*(EAZ+EAZI)                                               HGD01050
      WMYC2=(GY- COS(GY+TH)/TTW)*CP                                     HGD01060
      WMZC2=GZ*CP                                                       HGD01070
      WMYC3=CS*CN*EY+(T-T3-1.0)*4.0/VA                                  HGD01080
      IF(WMYC3.GE.0.50)WMYC3=0.50                                       HGD01090
      IF(WMYC3.LE.-0.50)WMYC3=-0.50                                     HGD01100
      WMZC3=CS*CN*EZ                                                    HGD01110
      IF(WMZC3.GE.0.50)WMZC3=0.50                                       HGD01120
      IF(WMZC3.LE.-0.50)WMZC3=-0.50                                     HGD01130
      T=T+DT                                                            HGD01140
      IF(VMX.GE.-50.0)GO TO 23                                          HGD01150
      GO TO 24                                                          HGD01160
 23   T5=T5+DT                                                          HGD01170
      T3=T-T5                                                           HGD01180
 24   T4=T3+2.0                                                         HGD01190
      IF(T.LE.T3)GO TO 25                                               HGD01200
      IF(T.GE.T4)GO TO 26                                               HGD01210
      WMYC=WMYC2                                                        HGD01220
      WMZC=WMZC2                                                        HGD01230
      GO TO 27                                                          HGD01240
 25   WMYC=WMYC1                                                        HGD01250
      WMZC=0.0                                                          HGD01260
      GO TO 27                                                          HGD01270
 26   WMYC=WMYC3                                                        HGD01280
      WMZC=WMZC3                                                        HGD01290
 27   WMX=WMX+(WMXC-WMX)*CTX*DT                                         HGD01300
      WMY=WMY+(WMYC-WMY)*CT*DT                                          HGD01310
      WMZ=WMZ+(WMZC-WMZ)*CT*DT                                          HGD01320
      PHD=WMX+(WMY*PH+WMZ)*SIN(TH)/COS(TH)                              HGD01330
      THD=WMY-WMZ*PH                                                    HGD01340
      PSD=(WMZ+WMY*PH)/COS(TH)                                          HGD01350
      PH=PH+PHD*DT                                                      HGD01360
      TH=TH+THD*DT                                                      HGD01370
      PS=PS+PSD*DT                                                      HGD01380
      GYD=CS*EY+WMX*SIN(GZ)-WMY*COS(GZ)                                 HGD01390
      GZD=CS*EZ-WMZ                                                     HGD01400
      GY=GY+GYD*DT                                                      HGD01410
      GZ=GZ+GZD*DT                                                      HGD01420
      IF(T.LE.(T2-DT))GO TO 30                                          HGD01430
 28   WRITE(6,29)T,XIM,YIM,ZDIF,VM,WMX,WMY,WMZ,PH,TH,PS,EY,EZ,          HGD01440
     QGY,GZ,AL,PHAL,T3                                                  HGD01450
 29   FORMAT(' ',F6.2,4F6.0,12F7.3,F5.2)                                HGD01460
      IF((ZIT-ZIM).LE.0.0)GO TO 31                                      HGD01470
      T2=T2+0.5                                                         HGD01480
 30   CONTINUE                                                          HGD01490
      IF(T.GE.15.0)GO TO 10                                             HGD01500
```

```
      GO TO 20                                                          HGD00151 0
   31 T6=(ZIM-ZIT)/VIZ                                                  HGD00152 0
      XERR=(XIM-XIT)-VIX*T6                                             HGD00153 0
      YERR=(YIM-YIT)-VIY*T6                                             HGD00154 0
      B=SQRT((ZIM-ZIT)**2+(VIX*T6)**2+(VIY*T6)**2)                      HGD00155 0
      C=SQRT(XERR**2+YERR**2)                                           HGD00156 0
      S=0.5*(RMT+B+C)                                                   HGD00157 0
      A=SQRT(S*(S-RMT)*(S-B)*(S-C))                                     HGD00158 0
      RERR=2.0*A/B                                                      HGD00159 0
      WRITE(6,32)XERR,YERR,RERR                                         HGD00160 0
   32 FORMAT('0','XERR=',F6.1,10X,'YERR=',F6.1,10X,'RERR=',F6.1)        HGD00161 0
      GO TO 10                                                          HGD00162 0
   33 CALL EXIT                                                         HGD00163 0
      STOP                                                              HGD00164 0
      END                                                               HGD00165 0
```

CLOSE ATTACK MISSILE SOLUTION

VA,ZIT,YIM,XIM,TM=
800.0 1000.0 1000.0 0.0 0.0

800.0 1000.0 1000.0 0.0 0.0

APPENDIX D

| T | XIM | YIM | ZDIF | VM | WMX | WMY | WMZ | PM | TM | PS | EY | EZ | GY | GZ | AL | PHAL | T3 |
|---|---|---|---|---|---|---|---|---|---|---|---|---|---|---|---|---|---|
| 0.50 | 372. | 1000. | 987. | 694. | 0.0 | -0.417 | 0.0 | 0.0 | -0.169 | 0.0 | -0.008 | 0.010 | 0.800 | 1.356 | 3.025 | -0.000 | 6.00 |
| 1.00 | 696. | 1000. | 971. | 607. | 0.0 | -0.159 | 0.0 | 0.0 | -0.317 | 0.0 | -0.001 | -0.031 | 0.822 | 1.266 | 2.882 | -0.000 | 6.00 |
| 1.50 | 975. | 1000. | 956. | 508. | 0.0 | 0.051 | 0.0 | 0.0 | -0.336 | 0.0 | -0.005 | -0.040 | 0.814 | 1.082 | 2.852 | -0.000 | 6.00 |
| 2.00 | 1202. | 1000. | 947. | 404. | 0.0 | 0.110 | 0.0 | 0.0 | -0.290 | 0.0 | -0.006 | -0.034 | 0.700 | 0.892 | 2.880 | -0.000 | 6.00 |
| 2.50 | 1378. | 1000. | 943. | 303. | 0.0 | 0.086 | 0.0 | 0.0 | -0.240 | 0.0 | -0.005 | -0.021 | 0.698 | 0.757 | 2.915 | -0.000 | 6.00 |
| 3.00 | 1505. | 1000. | 942. | 205. | 0.0 | 0.049 | 0.0 | 0.0 | -0.206 | 0.0 | -0.003 | -0.012 | 0.651 | 0.677 | 2.933 | -0.000 | 6.00 |
| 3.50 | 1583. | 1000. | 943. | 109. | 0.0 | 0.026 | 0.0 | 0.0 | -0.188 | 0.0 | -0.002 | -0.006 | 0.624 | 0.634 | 2.928 | -0.000 | 6.00 |
| 4.00 | 1613. | 1000. | 945. | 14. | 0.047 | 1.045 | 1.344 | -0.017 | -0.052 | 0.166 | -0.001 | -0.021 | 0.505 | 0.432 | 2.774 | -0.765 | 3.81 |
| 4.50 | 1598. | 930. | 939. | 87. | -0.093 | 0.269 | 0.183 | 0.040 | 0.348 | 0.628 | 0.000 | 0.001 | 0.113 | -0.071 | 0.080 | 1.765 | 3.81 |
| 5.00 | 1544. | 956. | 911. | 169. | 0.022 | -0.114 | -0.143 | -0.011 | 0.336 | 0.575 | 0.000 | -0.000 | 0.129 | -0.018 | 0.099 | -3.120 | 3.81 |
| 5.50 | 1453. | 896. | 859. | 291. | 0.017 | 0.002 | 0.005 | -0.001 | 0.310 | 0.547 | 0.000 | -0.001 | 0.156 | 0.006 | 0.138 | -2.970 | 3.81 |
| 6.00 | 1323. | 813. | 785. | 390. | -0.004 | 0.025 | -0.006 | 0.000 | 0.319 | 0.551 | 0.000 | -0.000 | 0.149 | 0.001 | 0.130 | -3.035 | 3.81 |
| 6.50 | 1155. | 707. | 690. | 487. | 0.005 | 0.040 | -0.020 | -0.001 | 0.335 | 0.544 | 0.001 | -0.000 | 0.135 | 0.006 | 0.117 | -2.999 | 3.81 |
| 7.00 | 951. | 579. | 573. | 582. | 0.010 | 0.058 | -0.030 | -0.002 | 0.359 | 0.530 | 0.001 | -0.001 | 0.115 | 0.010 | 0.099 | -2.892 | 3.81 |
| 7.50 | 711. | 431. | 434. | 673. | 0.013 | 0.083 | -0.034 | -0.003 | 0.394 | 0.512 | 0.001 | -0.001 | 0.086 | 0.030 | 0.076 | -2.674 | 3.81 |
| 8.00 | 437. | 264. | 273. | 761. | 0.014 | 0.127 | -0.025 | -0.003 | 0.445 | 0.495 | 0.002 | -0.000 | 0.044 | 0.043 | 0.051 | -2.156 | 3.81 |
| 8.50 | 13. | 81. | 87. | 848. | -0.008 | 0.305 | 0.099 | 0.005 | 0.539 | 0.502 | 0.008 | 0.004 | -0.030 | 0.042 | 0.054 | -0.021 | 3.81 |
| 8.71 | -14. | -5. | -4. | 889. | -0.075 | 0.434 | 0.349 | 0.030 | 0.619 | 0.563 | 0.566 | 0.504 | 0.079 | 0.155 | 0.113 | 0.161 | 3.81 |

XERR= -7.7 YERR= -0.9 RERR= 4.7

CLOSE ATTACK MISSILE SOLUTION

VA,ZIT,YIM,XIM,TM=
800.0 1000.0 0.0 0.0 0.0

800.0 1000.0 0.0 0.0 0.0

| T | XIM | YIM | ZDIF | VM | WMX | WMY | WMZ | PM | TM | PS | EY | EZ | GY | GZ | AL | PHAL | T3 |
|---|---|---|---|---|---|---|---|---|---|---|---|---|---|---|---|---|---|
| 0.50 | 372. | -0. | 987. | 694. | 0.0 | -0.417 | 0.0 | 0.0 | -0.169 | 0.0 | -0.054 | -0.000 | 1.429 | -0.000 | 3.025 | -0.000 | 6.00 |
| 1.00 | 696. | -0. | 971. | 607. | 0.0 | -0.159 | 0.0 | 0.0 | -0.317 | 0.0 | -0.046 | -0.000 | 1.307 | -0.000 | 2.882 | -0.000 | 6.00 |
| 1.50 | 975. | -0. | 956. | 508. | 0.0 | 0.051 | 0.0 | 0.0 | -0.336 | 0.0 | -0.030 | 0.000 | 1.139 | -0.000 | 2.852 | -0.000 | 6.00 |
| 2.00 | 1202. | -0. | 947. | 404. | 0.0 | 0.110 | 0.0 | 0.0 | -0.290 | 0.0 | -0.019 | 0.000 | 0.974 | -0.000 | 2.880 | -0.000 | 6.00 |
| 2.50 | 1378. | -0. | 943. | 303. | 0.0 | 0.086 | 0.0 | 0.0 | -0.240 | 0.0 | -0.011 | 0.000 | 0.850 | -0.000 | 2.915 | -0.000 | 6.00 |
| 3.00 | 1505. | -0. | 942. | 205. | 0.0 | 0.049 | 0.0 | 0.0 | -0.206 | 0.0 | -0.007 | -0.000 | 3.772 | -0.000 | 2.933 | -0.000 | 6.00 |
| 3.50 | 1583. | -0. | 943. | 109. | 0.0 | 0.026 | 0.0 | 0.0 | -0.188 | 0.0 | -0.003 | -0.000 | 0.729 | -0.000 | 2.928 | -0.000 | 6.00 |
| 4.00 | 1613. | -0. | 945. | 13. | -0.000 | 1.250 | -0.000 | 0.000 | -0.026 | -0.000 | -0.001 | 0.000 | 3.557 | -0.000 | 2.912 | -0.000 | 3.81 |
| 4.50 | 1595. | -0. | 938. | 88. | 0.000 | 0.281 | -0.000 | -0.000 | 0.435 | -0.000 | 0.000 | -0.000 | 0.096 | 0.000 | 0.004 | -3.142 | 3.81 |
| 5.00 | 1533. | -0. | 904. | 192. | -0.000 | -0.138 | 0.000 | 0.000 | 0.412 | -0.000 | 0.000 | -0.000 | 0.121 | -0.000 | 0.098 | -3.142 | 3.81 |
| 5.50 | 1427. | -0. | 844. | 295. | 0.000 | 0.004 | -0.000 | -0.000 | 0.382 | -0.000 | 0.000 | -0.000 | 0.152 | -0.000 | 0.137 | -3.142 | 3.81 |
| 6.00 | 1277. | -0. | 758. | 395. | 0.000 | 0.025 | -0.000 | -0.000 | 0.392 | -0.000 | 0.000 | -0.000 | 0.144 | 0.000 | 0.128 | -3.142 | 3.81 |
| 6.50 | 1084. | -0. | 648. | 493. | 0.000 | 0.040 | -0.000 | -0.000 | 0.408 | -0.000 | 0.001 | -0.000 | 0.130 | 0.000 | 0.114 | -3.142 | 3.81 |
| 7.00 | 849. | -0. | 513. | 588. | 0.000 | 0.062 | -0.000 | -0.000 | 0.433 | -0.000 | 0.001 | -0.000 | 0.109 | 0.000 | 0.092 | -3.142 | 3.81 |
| 7.50 | 575. | -0. | 353. | 679. | 0.000 | 0.099 | -0.000 | -0.000 | 0.473 | -0.000 | 0.002 | -0.000 | 0.076 | 0.000 | 0.060 | -3.142 | 3.81 |
| 8.00 | 264. | 0. | 168. | 768. | -0.000 | 0.199 | 0.000 | 0.000 | 0.542 | -0.000 | 0.004 | 0.000 | 0.020 | 0.000 | 0.005 | 3.142 | 3.81 |
| 8.39 | -11. | 0. | -2. | 843. | -0.000 | 0.441 | 0.000 | 0.000 | 0.671 | 0.000 | 0.982 | 0.000 | 0.124 | -0.000 | 0.103 | 0.000 | 3.81 |

XERR= -8.0 YERR= 0.0 RERR= 4.3

I claim:

1. A method of directing a close attack missile to a target, the missile being launched from an aircraft in the direction of the flight path of the aircraft, the method comprising the steps of:

(a) decelerating the launched missile by imparting a thrust thereto in a direction substantially opposite to the flight path of the launched missile so that the horizontal velocity of the missile approaches near zero;

(b) automatically controlling the direction of the thrust imparted to the missile so that the vertical velocity approaches near zero as the horizontal velocity approaches near zero;

(c) automatically reorienting the missile when the resultant horizontal and vertical velocity of the missile approach near zero so that the thrust vector of the missile is pointing almost directly at the target; and (d) automatically guiding the reoriented missile to the target along the line-of-sight from the missile to the target.

2. The method recited in claim 1 wherein step (b) is accomplished by maintaining the azimuth attitude of the missile and balancing the force of gravity with the vertical component of the thrust imparted to the missile.

3. The method recited in claim 1 including the step of: automatically introducing a gravity bias during the reorientation of step (c) to balance out the effect of the weight of the missile.

4. The method recited in claim 1 including the step of: automatically acquiring the location of the target prior to step (c).

5. The method recited in claim 1 wherein step (d) is accomplished by automatically guiding the missile along the line-of-sight from the center of the missile to the target.

6. The method recited in claim 1 wherein after step (c) the resultant force vector of the missile points directly at the target.

7. A method of directing a missile launched from a high speed aircraft, flying at low altitude, to a target, the missile being launched in the direction of the flight path of the aircraft, the method comprising the steps of:

(a) decelerating the launched missile by imparting a thrust thereto in a direction substantially opposite to the flight path of the launched missile so that the horizontal velocity of the missile approaches near zero;

(b) automatically controlling the direction of the thrust imparted to the missile during deceleration to maintain its azimuth attitude and cause the vertical velocity to approach near zero as the horizontal velocity approaches near zero by balancing the force of gravity with the vertical component of the thrust vector imparted to the missile;

(c) automatically reorienting the missile by changing its azimuth attitude and pitch attitude when the resultant horizontal and vertical velocity of the missile approaches near zero so that the resultant force vector of the missile is pointing directly at the target;

(d) automatically acquiring the location of the target prior to step (c); and (e) automatically guiding the missile to the target along the line-of-sight from the missile to the target.

8. The method recited in claim 7 wherein as a result of step (c) the missile thrust vector is pointing almost directly at the target.

9. The method claimed in claim 7 wherein a gravity bias is introduced during step (c) to take into account the weight of the missile in determining the direction of the thrust vector.

10. The method recited in claim 7 wherein as a result of step (c) the resultant velocity vector of the missile is pointing substantially directly at the target.

* * * * *